United States Patent [19]

Dueck et al.

[11] Patent Number: 4,809,921

[45] Date of Patent: Mar. 7, 1989

[54] APPARATUS FOR DISPENSING AND RE-ROLLING FLOOR COVERING MATERIALS

[75] Inventors: Willie B. Dueck, Box 700, Arborg, Manitoba, Canada, R0C 0A0; Delmer Plett, Arborg, Canada

[73] Assignee: Willie B. Dueck, Arborg, Canada

[21] Appl. No.: 150,735

[22] Filed: Feb. 1, 1988

[51] Int. Cl.[4] ..... B65H 17/12; B65H 25/26

[52] U.S. Cl. ..... 242/56 R; 242/66

[58] Field of Search ..... 242/56 R, 66, 58, DIG. 3

[56] References Cited

U.S. PATENT DOCUMENTS

| | | | |
|---|---|---|---|
| 2,595,593 | 5/1952 | Manning . | |
| 2,834,558 | 5/1958 | Halpin . | |
| 3,045,939 | 7/1962 | Vander Waal . | |
| 3,250,484 | 5/1966 | Fair | 242/66 |
| 3,386,678 | 6/1968 | Malone . | |
| 3,537,662 | 11/1970 | Keesling | 242/56 R |
| 3,643,885 | 2/1972 | Keesling et al. | 242/DIG. 3 X |
| 3,850,381 | 11/1974 | Moore | 242/66 |
| 3,931,940 | 1/1976 | Raighn et al. | 242/56 R |
| 4,002,308 | 1/1977 | Feighery . | |
| 4,120,463 | 10/1978 | Alinder et al. . | |
| 4,273,300 | 6/1981 | Wojtowicz et al. . | |

*Primary Examiner*—Stuart S. Levy
*Assistant Examiner*—Steven M. duBois
*Attorney, Agent, or Firm*—Stanley G. Ade; Adrian D. Battison; Murray E. Thrift

[57] ABSTRACT

A device for measuring and re-rolling floor covering material, particularly carpet comprises a base member having sides and a transverse table top. On each side of the table top is mounted a cradle which extends downwardly from the table top and outwardly to the side of the device. Each cradle is formed by four rollers, two of which are carried directly on the base and two of which are cantilevered outwardly therefrom and are pivotally moveable inwardly to a retracted position. The re-roll cradle allows two of the rollers to pivot about the axis of the next adjacent roller so that the rollers can be folded inwardly to form a confined space acting to commence the re-rolling of a carpet edge. A knife is carried on a chain movable across the table top and includes guide wheels which hold the carpet down onto the knife blade.

2 Claims, 4 Drawing Sheets

APPARATUS FOR DISPENSING AND RE-ROLLING FLOOR COVERING MATERIALS

BACKGROUND OF THE INVENTION

This invention relates to an apparatus for dispensing and re-rolling floor covering materials and particularly but not exclusively carpeting.

Carpeting is delivered and stored in large rolls which are convenient to mount in racks or even to lie simply in stacks. Generally in the carpet retailing industry, a rolled supply of a particular carpet to be sold is laid on the floor and unrolled across the floor so as to expose the length of carpet which is to be supplied, following which the carpet is cut at the required length. The remainder of the roll is then removed and replaced in the rack or on the stack and the cut carpet is simply rolled up across the floor following which is may be packaged or tied for delivery purposes.

This technique has disadvantages for a number of reasons. Firstly a relatively large amount of floor area must be set aside for unrolling the carpet since the floor area must exceed the typical lengths of carpet which will be supplied in a retail situation. Secondly the carpet when unrolled on the floor is exposed to dirt and deterioration. Thirdly the handling of the supply roll and the re-rolling of the cut carpet is generally a two person operation and is lengthy, time consuming and thus inefficient in personnel cost. Fourthly, the taking of inventory of a length of carpet rolls remaining in stock must be handles in basically the same way in that the carpet must be unrolled manually and then re-rolled with a measuring taking placing by laying the carpet across the floor and the use of a tape measure.

Various attempts have therefore been made to design and manufacture an automated device which will assist in the dispensing, measuring and re-rolling of carpet materials which overcomes the above disadvantages of the strictly manual process which is currently in use in almost all carpet retailing stores.

A search has revealed the following U.S. patents showing devices of this general type: U.S. Pat. No. 3,386,678 (Malone), U.S. Pat. No. 2,595,593 (Manning), U.S. Pat. No. 3,045,939 (Van der Waal), U.S. Pat. No. 2,834,558 (Halpin), U.S. Pat. No. 4,002,308 (Feighery), U.S. Pat. No. 4,120,463 (Alinder), and U.S. Pat. No. 4,273,300 (Wojtowicz).

Wojtowicz shows an arrangement including first and second cradles, each defined by a pair of rollers and belts wrapped around those rollers so that carpet can be unrolled from one cradle onto the other cradle and wrapped into a new roll around a cylindrical core. The machine is however extremely complicated, massive and expensive and accordingly has not been commercially successful.

Feighery shows again a very complicated arrangement including two separate frame work structures and concentrates particularly on the rewind mechanism which includes hydraulic actuation. Again therefore the device is much too complicated and expensive for operation at reasonable capital cost in a retail situation.

Alinder shows an arrangement which again is highly complex involving movement of a carriage longitudinally of the frame so as to be able to cut the material lengthwise as well as crosswise. The material is then wound onto a cylindrical core which is unsuitable for retail dispensing unless the core is removed by yet further handling of the heavy carpet rolls.

Halpin discloses an arrangement comprising two separate frame structures, one for supporting the supply roll and the other including a re-roll arrangement. Again, the device uses a central core for rolling the fresh roll of carpet and is unsatisfactory in design and construction making it difficult for use by a single operative.

SUMMARY OF THE INVENTION

It is one objective of the present invention therefore to provide an improved device of this general type for dispensing and re-rolling floor covering materials.

According to the first aspect of the invention thre is provided apparatus for dispensing and re-rolling floor covering material comprising an elongate base member defining two sides and a top surface and having means for resting of the base member upon a floor surface, a first cradle mounted on the base member along one side thereof and comprising a plurality of spaced rollers each lying parallel to said one side of the base member from an innermost one of the rollers adjacent to an edge of the top surface with each of the further rollers in turn being spaced further from the edge of the top surface, means supporting the rollers such that their axes lie on an arc of a circle so as to cradle a roll of floor covering lying thereon, and means for drivingly rotating the roller each about its respective axis for rotating the roll of floor covering, a second cradle mounted on the base member along an opposed side thereof and comprising a plurality of spaced rollers each lying parallel to said opposed side from an innermost one of the rollers adjacent to an opposed edge of the top surface with each of the further rollers being spaced in turn further from the opposed edge, means supporting the rollers such that their axes lie on an arc of a circle to cradle a roll of floor covering lying thereon and means for drivingly rotating the rollers each about its respective axis so as to rotate the roll of floor covering to form the floor covering into the roll, means for commonly driving said first and second cradle such that rotation of the roll on the first cradle causes the floor covering material to be fed therefrom across said top surface to said roll forming on said second cradle, a measuring roller mounted in said top surface for measuring a length of the material fed there across and a cutting knife member mounted in said top surface with a knife blade thereof movable longitudinally the top surface to cut a measured length of the floor covering.

According to a second aspect of the invention there is provided apparatus for dispensing and re-rolling floor covering material comprising an elongate base member defining two sides and a top surfce and having means for resting of the base member upon a floor surface, a supply roll cradle mounted on the base member along one side thereof and comprising a plurality of spaced rollers each lying parallel to said one side of the base member from an innermost one of the rollers adjacent to an edge of the top surface with each of the further rollers in turn being spaced further from the edge of the top surface, means supporting the rollers such that their axes lie on an arc of a circle so as to cradle a roll of floor covering lying thereon, and means for driving the rotating the rollers each about its respective axis for rotating the roll of floor covering, and a rewind roll cradle mounted on the base member along an opposed side thereof and comprising a plurality of spaced rollers each lying parallel to said opposed side from an innermost one of the rollers adjacent to an opposed edge of the top surface with each of the further rollers being spaced in turn further from the opposed edge, means supporting the rollers such that their axes lie on an arc of a circle to cradle a roll of floor covering lying thereon and means for drivingly rotating the rollers each about its respective axis so as to rotate the roll of floor covering to form the floor covering into the roll, at least one of said rollers being mounted in fixed position on said base member, a first pair of lever members each arranged at a respective end of the base member with the first pair carrying a further roller for pivotal movement of the further roller about an axis parallel to said rollers, and a second pair of lever members each arranged at a respective end of the frame base member and supporting a yet further roller, said second pair of lever members providing pivotal movement of said yet further roller about an axis parallel to the rollers, whereby the yet further roller and the further roller can be folded inwardly to define an enclosed area between the rollers for commencing rolling movement of an edge of the floor covering material forwarded thereto.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
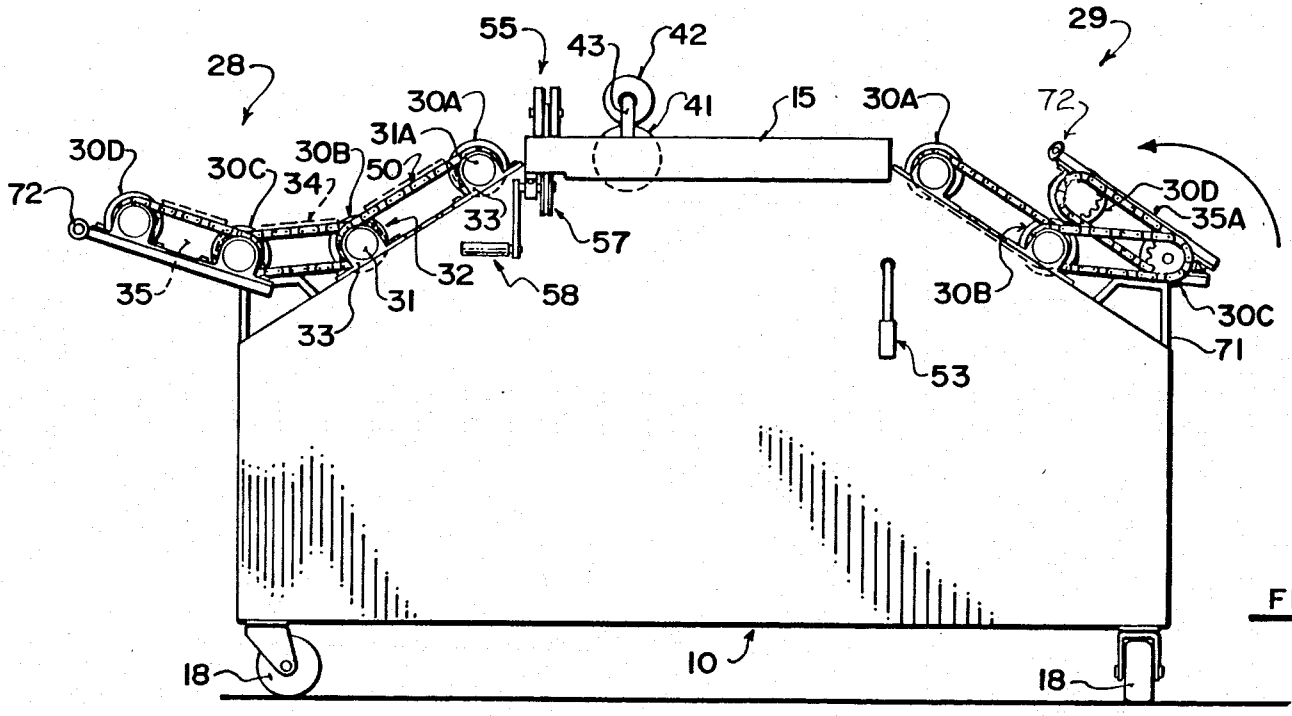
FIG. 1 is an end elevational view of a carpet dispensing and re-rolling machine according to the invention.

The device as shown in the drawings comprises a base member generally indicated at 10 which is formed of a tubular frame structure generally indicated at 11 to define an undersurface 12, a pair of vertical sides 13 and 14, a horizontal table top surface 15 and two ends 16 and 17. Each of the sides, ends and table surface is defined by a sheet metal panel such as to define a clean outer surface. The frame 11 at the underside 12 carries castor-wheels 18 arranged at four corners of the rectangular frame so that the base member can be readily wheeled manually from place to place as is required for storage or for operation within an open area.

Figure 2:
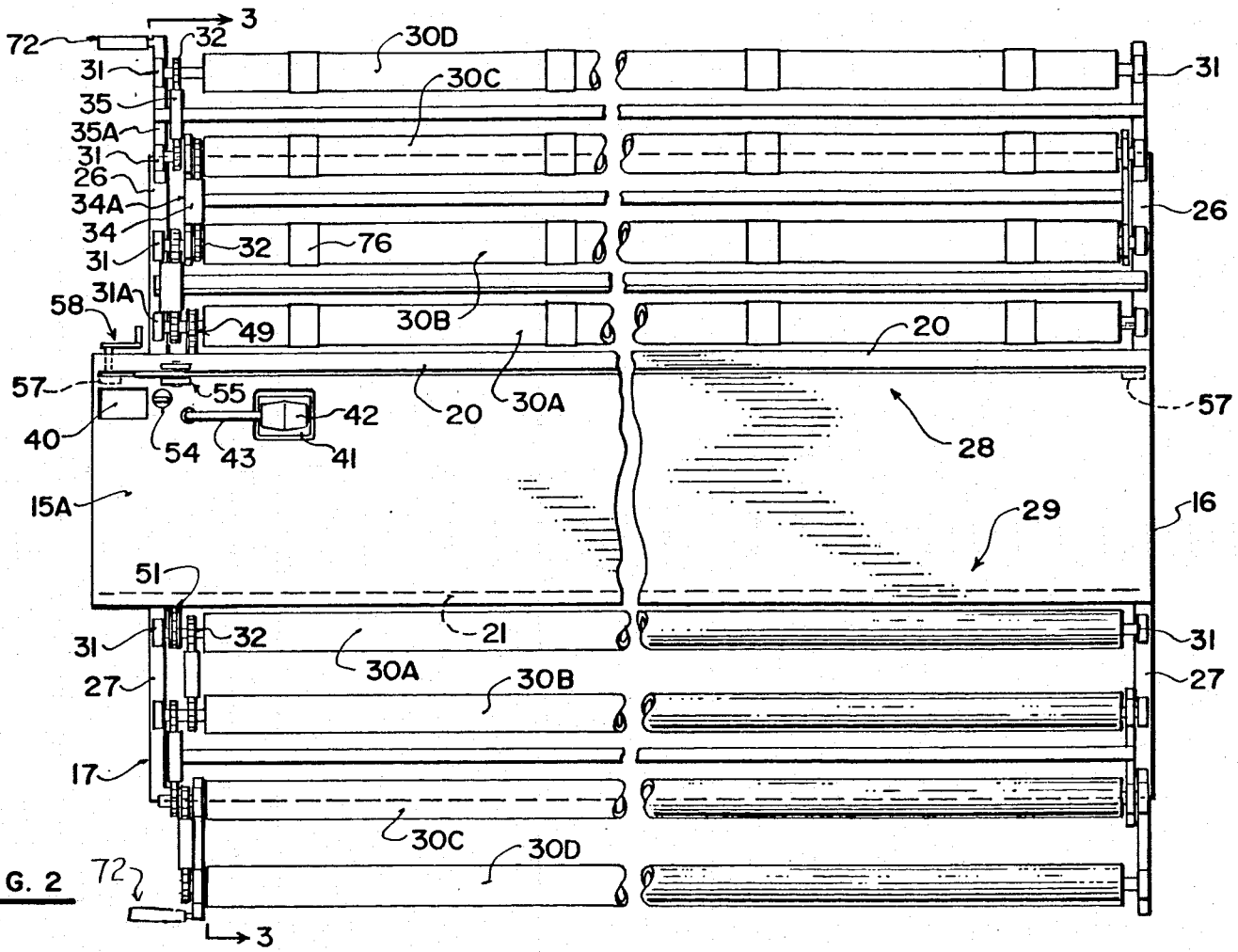
FIG. 2 is a top plan view of the machine of FIG. 1.

The width of the table surface 15 is approximately one-third of the width of the underside with the side edges of the table surface 15 being defined by elongate structural members 20 and 21. The upper edges of the sides 13 and 14 are similarly defined by elongate structurally members 22 and 23 arranged at a height approximately one-half the distance between the underside of the top surface so as to define inclined sides of the device indicated at 24 and 25. Each of the sides is formed by a strut 26, 27 which interconnects the structural beams at the sides and top of the device with the area between the struts 26 open as best shown in FIG. 2.

On each inclined side of the device is formed a separate one of a pair of cradles generally indicated at 28 and 29. Basically each of the cradles is constituted by four rollers 30 which are arranged in parallel spaced relationship and extending longitudinally of the frame structure covering the open sides and extending outwardly therebeyond to a position slightly outwardly of the sides 13 and 14.

Each of the rollers 30 is carried for rotation about its axis in bearings 31. Each of the rollers carries chain wheel drive members 32 by which it can be drivingly rotated about its axis defined by the bearings 31. An innermost one of the rollers indicated at 30A is mounted immediately adjacent the respective side edge of the top surface 15. For this purpose the respective bearing of the roller 30A indicated at 31A is mounted in a strap 33 on an upper surface of the strut 26, 27 so as to be maintained in fixed position at the edge of the top surface 15 but able to rotate about the axis of the roller 30A as driven by the chain wheel 32.

A second of the rollers 30B is similarly mounted in a strap 33 on the strut 26 at a position downwardly and outwardly of the first roller 30A.

A further or third roller indicated at 30C is carried at a position as shown in FIG. 1 in which it is substantially at the same height as the roller 30B but spaced outwardly therefrom. A yet further roller indicated at 30D is positioned outwardly and upwardly relative to the roller 30C so as to lie at a height substantially equal to the height of the roller 30A. In this way the rollers form a cradle with their axes lying on an arc of a circle which approximates the size of a roll of the material. It will of course be appreciated that the roll will vary in size depending upon the amount of material remaining but in practice a spacing between the outer roller 30D and the innermost roller 30A might be of the order of 18 inches with a diameter of curvature of the arc defined by the axis of the rollers being of the order of 24 to 36 inches so as to act as a compromise between the largest and smallest diameters of roll which might be accommodated.

While the rollers 30A and 30B are fixed upon the sides of the machine, the rollers 30C and 30D are pivotally mounted and hence are carried upon levers 34 and 35 respectively. The cradle 28 of the device which is intended to act as a roll-up cradle has the levers 34 and 35 formed separately with each defining pivotal movement of the respective roller 30C and 30D about an axis parallel to the rollers and spaced inwardly of the respective roller. Thus the roller 30D is effectively pivotal about the axis of the roller 30C on the lever 35 and the roller 30C is in turn pivotal about the axis of the roller 30B on the lever 34.

In regard to the cradle 29 which is intended to act as a supply cradle for the supply roll, the levers indicated at 34A and 35A are rigidly connected so that the only pivotal movement allowed of the rollers 30C and 30D of the cradle 29 is about the axis of the roller 30B. Each of the cradles includes a manually graspable handle 72 extending axially at the outermost roller at a position slightly beyond the end of the lever 35.

Figure 3:
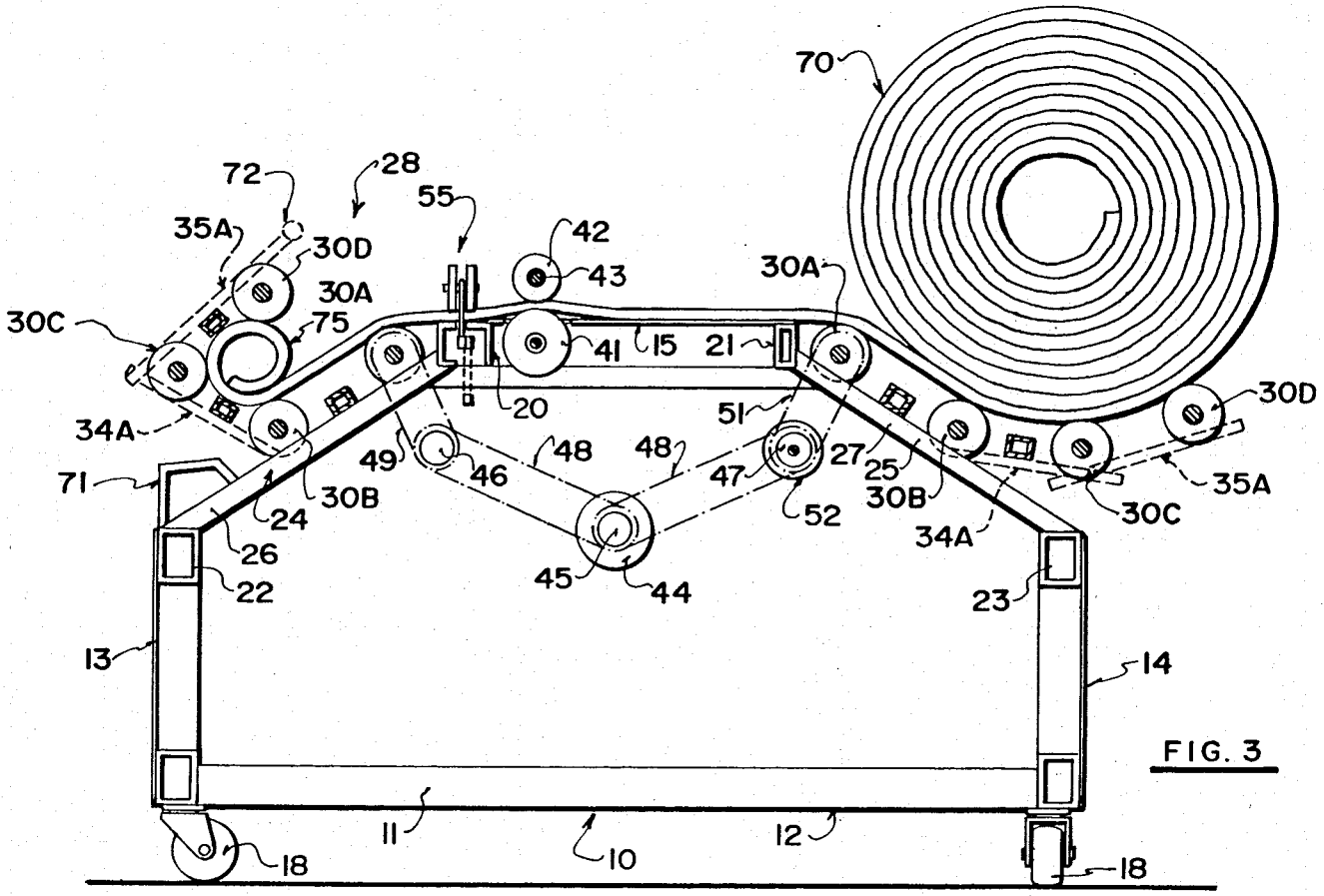
FIG. 3 is a cross-sectional view along the lines 3—3 of FIG. 2.

In this way both of the cradles 28 and 29 can be moved from an outward cradling position shown in respect of the cradle 28 in FIG. 1 and shown in respect of the cradle 29 in FIG. 3. In this cradling position, the outer roller 30D extends outwardly to the side of the machine with the axes of the rollers lying on the arc of the circle to receive resting in the cradle a relatively large roll. In addition both of the cradles can be folded inwardly to a folded position shown in respective of the cradle 28 in FIG. 3 and shown in respect of the cradle 29 in FIG. 1. In these folded-in positions, both of the cradles are reduced in width so that the whole of the machine has a reduced width to the extent only of the sides 13 and 14. In this way the machine can be stored in an area of the size of the base section which in a practical example can be of the order of four feet wide and fourteen feet long.

As shown best in FIG. 2, the top table surface 15 defined by the structural members 20 and 21 and the flat sheet therebetween extends outwardly beyond one end of the base as indicated at 15A. As the rollers 30 have a length substantially equal to the length of a carpet roll which is conventionally either four meters or 12 feet. The forward portion 15A of the top surface is in operation left free of carpet and can act as a table top for papers of the operative. In addition, the forward portion 15A carries a display panel or gauge 40 of a metering roller 41 mounted within the top surface to be engaged by carpet moving across the top surface. The metering roller 41 is received within a recess in the top surface so that only a portion of the roller 41 projects through the recess for engaging the carpet. A nip roller 42 is carried on an arm 43 which is spring biased to form a nip between the rollers 41 and 42 to press the carpet material therebetween. The arm 43 can be lifted against the spring bias to a retracted position and which it can latch for example by an over centre arrangement (not shown).

As shown in FIG. 3, a motor 44 is mounted within the base member for driving the rollers 30 of both of the cradles 28 and 29. The motor carries a pair of chain wheels 45 which respectively drive idler sprockets 46 and 47 through chains 48. From the sprocket 46, a drive train generally indicated at 49 extends to drive each of the rollers 30 of the cradle 28. For this purpose each of the rollers 30A, 30B, 30C carries a pair of chain wheels 32 so that the drive can be transmitted each to the next for common rotation of the rollers about their respective axes. For purposes of safety, the chains interconnecting the respective chain wheels 32 are covered by cover plates 50 which prevent an operative's fingers becoming trapped between the chain and the respective chain wheel.

Similarly a drive train 51 communicates drive from the sprocket 47 to each of the rollers 30 of the cradle 29. A clutch schematically indicated at 52 operable by a lever 53 shown in FIG. 1 can disconnect drive from the motor 44 to the cradle 29 as required by the operative. The motor can be operated in forward or reverse directions by a switch schematically indicated at 54 as shown in FIG. 2.

A knife mechanism for cutting the floor covering material is generally indicated at 55. The knife mechanism comprises a chain 56 which extends along the full length of the machine and cooperates with chain wheels 57 at the inward and outward ends respectively so as to define an upper run of the chain which passes along the inside of the tubular structural member and a lower run of the chain which runs along the underside of the structural member 20. The chain wheel 57 at the inward end of the machine can be driven to rotate to move the chain longitudinally of the machine by a hand crank 58 mounted on one side face of the top surface. As an alternative, a drive motor can be provided within the top surface for directly driving the chain wheel 57 under control of a suitably positioned manual switch.

Figure 5:
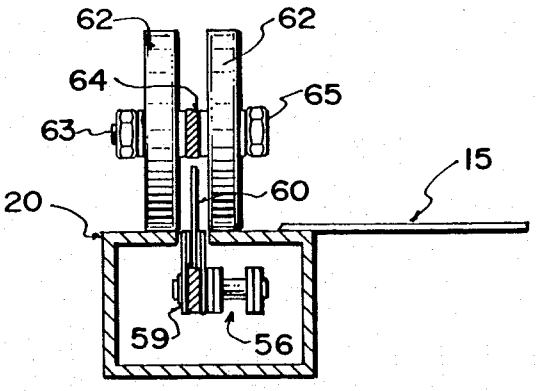
FIG. 5 is a cross-sectional view along the lines 5—5 of FIG. 4.
Figure 4:
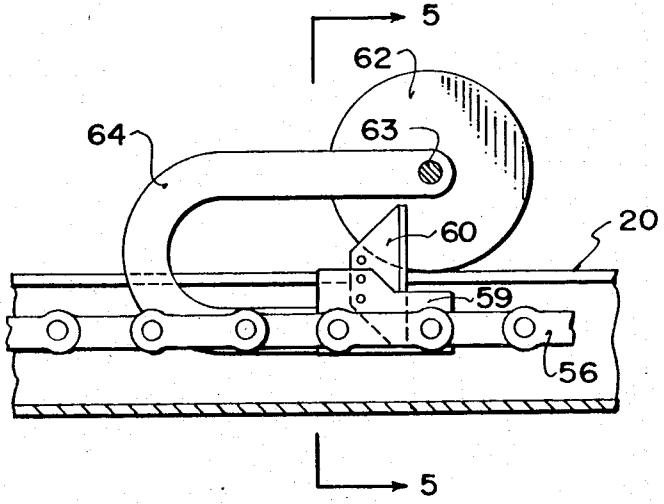
FIG. 4 is a side-elevational view of a detail of the machine of FIG. 1 showing the knife construction.

As best shown in FIGS. 4 and 5, the chain 56 carries a block 59 on one side of the chain which supports firstly a utility blade 60 which is of the conventional form to enable ready replacement. The blade 60 projects upwardly through a slot 61 in the upper surface of the structural member 20 so the blade runs along the length of the top surface as it is carried longitudinally by the chain 56. Thus the blade projects upwardly from the undersurface of the carpet material for cutting through the backing of the carpet material. To retain the carpet material in position pressed downwardly onto the blade, there is provided a pair of wheels 62 which are mounted on either side of the blade 60 so that the blade 60 projects into the space between the wheels. The wheels are mounted upon a common axle 63 which is carried upon a curved support strut 64 which has a first portion extending parallel to the chain and a second portion curving downwardly toward the chain. The axle 63 includes a pin 65 which can be pulled to allow the wheels to be removed from the support member 64 to allow access to the blade 60 so that it can be removed for turning to present a new portion of the blade or for replacement if the blade is fully worn.

In operation, the support cradle 29 is moved from its folded position shown in FIG. 1 into the open position shown in FIG. 3. In this position, a carpet roll indicated at 70 can be placed upon the cradle. In order to reduce the stress upon the levers 34A and 35A, a pair of vertical struts 71 is provided at opposed ends of the frame which help support the outermost rollers 30C and 30D of the cradle 29 when the carpet roll is of the maximum weight.

The nip roller 42 is then lifted away from the top surface 15 and the motor 44 is actuated to commence the rotation of the rollers of the cradles in a direction to rotate the roll 70 in a clockwise direction as shown in FIG. 3 so that an edge of the carpet is fed across the top surface 15 toward the cradle 28. At this point the knife mechanism is fully retracted to the drive chain wheel 57 so that it lies on the extension 15A of the top surface out of the path of the carpet. The carpet can thus freely pass across the upper surface until the edge of the carpet reaches the metering roller 41 and the slot 61 of the knife mechanism. The nip roller 42 is lowered into place and the gauge 40 is reset to zero. The movement of the rollers 30 is then recommenced by actuating the motor 44 so that the edge of the carpet is forwarded beyond the left hand edge of the top surface 15 onto the cradle 28. At this point the cradle 28 is moved inwardly by the manually actuable handle 72 into the folded position shown in FIG. 3. In this position the carpet edge passes between the rollers 30A and 30D into a confined area formed by all of the rollers and particularly the three rollers 30B, 30C and 30D. In this confined area the carpet edge is caused to turn in a clockwise direction to form a roll of the material. The pressure on the forming roll can be controlled by the manual actuation of the handle 72 so that the operative presses down upon the handle initially to commence the roll and then gradually releases the pressure as the roll increases in size to a point where the roll is of sufficient size so it will be driven to form a sufficiently tight roll while the cradle 28 is in its fully opened position. The amount of force to be manually applied can be readily gauged by the operative.

In order to assist in driving the forming roll indicated at 75, each of the rollers of the cradle 28 has along its length spaced bands 76 of a roughened material for example emery cloth which is adhesively attached to the roller to increase the friction between the roller and the forming roll 75.

Provided the roll 75 is properly and squarely commenced, the symmetry of the system will generally cause the supply roll and the forming roll to remain properly centered. Thus the slot 61 remains directly and accurately square to the edges of the carpet.

If at any time the rolling of the carpet becomes slightly off-center, the operative can apply sufficient force longitudinally of the carpet on the top surface or table 15 to restore the proper centered rolling of the carpet. If sufficient force cannot be applied in this way, the machine can be stopped and the centering restored with the machine halted.

When sufficient carpeting has been fed past the metering roller 41 as indicated by the gauge 40, the machine can be halted and the knife actuated to cause slitting of the carpet at the required location. The knife is actuated by operating the hand crank 58 so as to drive the knife across the width of the carpet to a suitable end stop adjacent the outer chain wheel 57. The controlled cutting provided by the cooperation of the knife blade and the wheels ensures that the carpet is properly and accurately slit along a straight line with no opportunity for deviation or fraying. The pressure applied in the cutting effect can also handle foam backed carpets which are notoriously difficult to slit without tearing of the foam.

When the required length has been cut, the clutch 52 can be operated so that the cradle 29 is maintained stationary. The cradle 28 can then be restarted which will continue to rotate the re-rolled cut length of the carpet which is required to be deliverd. This rolling action can be used to wrap around the carpet roll a covering material for example a plastic sheet for packaging the roll and in addition the plastic sheet can be located in place by suitable tape or string applied around the roll as the covered roll continues to rotate. When completed the roll can be simply manually removed from the cradle and carried on a dolly or forklift for dispatch.

When the packaged roll has been removed, the motor 44 can be reversed to rewind the material back onto the supply roll 70 so the supply roll can be lifted away from the cradle 29 for return to storage again either on a suitable dolly or a forklift.

The machine as described above has a number of advantages as follows:

1. The length of material to be cut is properly and accurately measured with little or no opportunity for error.

2. The cut is completely square since the carpet will necessarily be properly square across the top surface 15 provided the rolls are maintained properly centered.

3. The width of the top surface allows a portion of the carpet to be available for inspection as it moves across the top surface from the supply roll to the re-roll.

4. No flooring core is necessary for the rewinding although one can be used if the retailer or customer requires.

5. The machine comprises a single simple device which can be rolled from one piece to another and stored in a limited space. It is of a simple nature and hence can be manufactured at relatively low capital cost.

6. The device can be operated by a single operative with high efficiency in some cases enabling cutting to be carried out at four times the rate possible with a conventional floor unrolling technique.

7. The controlled knife ensures a clean accurate cut.

8. The material is maintained in a clean environment without necessity for ever contacting the floor.

9. The device can be used for inventory purposes merely re-rolling a supply roll completey from the cradle 29 onto the cradle 28 and of course measuring the amount of material passing over the metering roll as the roll is re-rolled.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. Apparatus for dispensing and re-rolling floor covering material comprising an elongate unitary base frame member defining an elongate planar top table surface, two vertical ends frame portion each at a respective end of the table surface and two side frame portions each along a respective side of the table surface and having means for resting of the base frame member upon a floor surface, a first cradle mounted on the base member on one of said side frame portions thereof and comprising a plurality of spaced cylindrical rollers each extending along substantially the full length of the table surface and lying parallel to one side edge of the table surface with an innermost one of the rollers lying immediately adjacent to and no higher than said side edge of the table surface with each of the further rollers in turn being spaced further from the side edge of the table surface and lower than said inner most roller, said end frame portions each including a frame strut member extending outwardly from the respective side of the table surface and supporting bearing means thereon for supporting the rollers extending between said end frame portion such that their axes lie on an arc of a circle so as to cradle a roll of floor covering lying thereon, and means for drivingly rotating the rollers each about its respective axis for rotating the roll of floor covering, a second cradle mounted on the base member on the other of said side frame portions thereof and comprising a plurality of the table surface and lying parallel to one side edge of the table surface with an innermost one of the rollers lying immediately adjacent to and no higher than said side edge of the table surface with each of the further rollers being spaced in turn further from said side edge of said table top and lower than said innermost roller, said end frame portions each including a second frame strut member extending outwardly from the respective side of the table surface and supporting bearing means thereon for supporting the rollers extending between said end frame portions such that their axes lie on an arc of a circle to cradle a roll of floor covering lying thereon and means for drivingly rotating the rollers each about its respective axis so as to rotate the roll of floor covering to form the floor covering into the roll, at least an outermost one of said rollers being mounted for pivotal movement about an axis inwardly of said outermost roller for confining an end of the floor covering material for winding, said roller including a handle for manual movement thereof, means for commonly driving said first and second cradles such that rotation of the roll on the first cradle causes the floor covering material to be fed therefrom across said table surface to said roll forming on said second cradle, a measuring roller mounted in a recess in said top surface for measuring a length of the material fed there across, a slot in said table top extending longitudinally thereof and a cutting knife member mounted in said table surface with a knife blade thereof movable longitudinally of the table surface in said slot to cut a measured length of the floor covering material said cutting knife member comprising a support member mounted beneath said table top for movement therealong under said slot, said knife blade being mounted on said support member so as to project through the slot to a position above the table top to cut the floor covering thereon, and means for clamping the floor covering down onto the table top at the slot during cutting consisting solely of a pair of wheel means each arranged on a respective side of the blade with a common axle of the wheel means lying above the table top and transverse to the slot and a connecting member extending from said axle to said support member and passing through said slot at a position rearwardly of said blade relative to a cutting direction of said blade.

2. The invention according to claim 1 wherein the rollers of the second cradle each include a plurality of bands of abrasive material spaced along the length thereof each band providing a roughened portion for increased friction against the floor covering material.

* * * * *